US008202624B2

(12) United States Patent
Becher et al.

(10) Patent No.: US 8,202,624 B2
(45) Date of Patent: Jun. 19, 2012

(54) COATED PAPERS HAVING IMPROVED LABELLING PROPERTIES

(75) Inventors: Hans-Joachim Becher, Numbrecht (DE); Andreas Euler, Pulheim (DE); Udo Sundram, Bergisch (DE)

(73) Assignee: M-Real Oyj, Espoo (FI)

( * ) Notice: Subject to any disclaimer, the term of this patent is extended or adjusted under 35 U.S.C. 154(b) by 625 days.

(21) Appl. No.: 12/302,266

(22) PCT Filed: May 16, 2007

(86) PCT No.: PCT/EP2007/004342

§ 371 (c)(1), (2), (4) Date: May 29, 2009

(87) PCT Pub. No.: WO2007/134762

PCT Pub. Date: Nov. 29, 2007

(65) Prior Publication Data

US 2009/0301631 A1 Dec. 10, 2009

(30) Foreign Application Priority Data

May 23, 2006 (EP) ..... 06010595

(51) Int. Cl.
*B32B 5/16* (2006.01)

(52) U.S. Cl. ..... 428/532; 428/537.5; 427/322; 427/324; 427/326; 427/391

(58) Field of Classification Search ..... 428/537.5, 428/532; 427/322, 324, 326, 391
See application file for complete search history.

(56) References Cited

U.S. PATENT DOCUMENTS

| | | | | |
|---|---|---|---|---|
| 2,045,096 | A | | 6/1936 | Osborne |
| 2,943,954 | A | | 7/1960 | Robinson et al. |
| 2,997,406 | A | | 8/1961 | Freeman et al. |
| 4,515,833 | A | | 5/1985 | Nojima et al. |
| 4,529,992 | A | | 7/1985 | Ishida et al. |
| 4,567,098 | A | | 1/1986 | Becker et al. |
| 4,581,257 | A | | 4/1986 | Kondo et al. |
| 4,889,234 | A | * | 12/1989 | Sorensen et al. ..... 206/459.5 |
| 5,209,982 | A | * | 5/1993 | Defrenne ..... 428/511 |
| 5,904,971 | A | * | 5/1999 | Anderson et al. ..... 428/112 |
| 2006/0293183 | A1 | | 12/2006 | Kenney et al. |

FOREIGN PATENT DOCUMENTS

| | | | | |
|---|---|---|---|---|
| DE | 3340945 | | | 5/1984 |
| DE | 4415547 | C2 | | 11/1995 |
| EP | 0098368 | | * | 1/1984 |
| EP | 0098368 | A2 | | 1/1984 |
| EP | 0120095 | A1 | | 10/1984 |
| EP | 0 341 229 | A | | 11/1989 |
| EP | 0 428 057 | A | | 5/1991 |
| EP | 0637514 | | | 2/1995 |
| EP | 0685344 | A2 | | 12/1995 |
| EP | 0732219 | A2 | | 9/1996 |
| EP | 0770493 | A1 | | 5/1997 |
| EP | 0 870 867 | A2 | | 10/1998 |
| EP | 1522629 | | * | 4/2005 |
| EP | 1522629 | A1 | | 4/2005 |
| GB | 2210064 | A | | 6/1989 |
| JP | 01298295 | A | | 12/1989 |
| JP | 11058958 | | | 3/1999 |
| JP | 2008 246737 | | | 10/2008 |
| WO | WO 02072359 | | | 9/2002 |

* cited by examiner

*Primary Examiner* — Leszek Kiliman

(74) *Attorney, Agent, or Firm* — Knobbe Martens Olson & Bear LLP

(57) ABSTRACT

A process for producing a coated paper, comprising the steps of: a) providing a base paper, the fraction of long-fiber chemical pulp in the base paper being at least 25% by weight, the base paper leaving an absolute moisture content of ISO 287 of not less than 2.5%, the base paper having a water absorbency to ISO 535 for a test time of 10 s ($Cobb_{10}$) of 5 to 20g/m$^2$, and the base paper having a (Fenchel) wet elongation, measured parallel to the machine direction, of not greater than 0% and, measured transverse to the machine direction, of not greater than 3%, b) applying 10 to 40g/m$^2$ (ovendry) of an aqueous coating composition to at least one face of the base paper, to give a coated base paper, and c) conditioning the coated paper obtained in step b).

27 Claims, No Drawings

COATED PAPERS HAVING IMPROVED LABELLING PROPERTIES

This application is U.S. National Phase of International Application PCT/EP2007/004342, filed May 16, 2007 designating the U.S., and published in Deutsch as WO 2007/134762 on Nov. 29, 2007, which claims priority to European Patent Application No. 06010595.4, filed May 23, 2006.

The present invention relates to a coated paper having improved labelling properties and also to a process for producing such paper.

Coated papers find a multiplicity of applications. They frequently feature a very smooth, coated surface, on which high-value prints can be applied, in particular by offset printing. Accordingly, coated papers also find use for the branding and labelling of products. A principal area of application in this context is the labelling of bottles. The prior art has disclosed various methods of labelling bottles, including the application of self-adhesive sticky labels, and also "wet labelling".

In wet labelling the reverse face of the ready-printed label is coated with a layer of adhesive, which is then applied immediately to the bottle to be labelled. The adhesive generally includes a high water content and often has a casein-based composition.

The automatic labelling machines process up to several tens of thousands of bottles per hour, which means that it is necessary to ensure a high level of reliability on the part of the labelling operation. It is necessary in particular that the labels can be applied in good alignment to the bottles, so that skewed positioning of the label on the bottle is avoided. It is also necessary that the labels adhere to the bottles immediately after application, since otherwise, as a result of further mechanical contact, as for example with brushes used to press the label firmly to the bottles, they can slip. Since the surface to be labelled (adhesion surface) is curved, corresponding to the shape of the bottle, there is also a risk that, in spite of the brush action, the two-dimensional label may not conform ideally to the curvature. A frequent observation, as a consequence of inadequate conformance, is that the corners and edges of the label fail to bond fully to the adhesion surface beneath it, and, accordingly, stick out. A further risk in principle is that the labels will slip from the bottles and hence clog conveyor belts or other mechanical installations of the bottling plant.

In the prior art there has been no lack of attempts to produce papers having improved properties for wet labelling.

U.S. Pat. No. 5,209,982 discloses a method of manufacturing labelling paper for bottles. A feature of the labelling paper is that the reverse face of the label, the face to which the adhesive is applied on labelling, bears a coating which enhances the label's suitability for labelling. As a result of the coating, the water absorption of the reverse face is improved, with the consequence that, as a result of water penetration, the rigidity of the base material is impaired. To this end it is proposed that a particularly active absorbing agent be used.

From the prior art there are also processes known which are aimed at improvements in the labelling characteristics on curved surfaces, at the expense of the strength properties of the label paper. They involve producing elongation lattices on the label by means of punch cuts, which breaks the inherent rigidity of the label and prevents its corners and edges lifting from the substrate. A disadvantage is the additional process step of punch cutting, and also the associated mechanical damage to the material.

German patent DE 44 15 547 C2 describes a paper label for bottles which is printed and is applied by means of a glue, and whose fibres are oriented principally in one direction. In order to prevent the occurrence of sticking-out edges and corners during the labelling procedure on curved surfaces, it is proposed that the label be embossed perpendicular to the fibre direction, thereby ensuring that the label will wrap itself more rapidly and less problematically around adhesion surfaces, even highly curved adhesion surfaces. A disadvantage here, again, is the additional process step of the embossing, which likewise leads to weakening of material as a result of fibre breaks in the fibre web.

Also known from the prior art are numerous metallized coated papers. EP 0 098 368 A2 discloses a cast-coated metallized paper in which the cast coat includes, in addition to other ingredients, a synthetic polymer pigment. Because of the specific composition of the cast-coated paper, therefore, subsequent treatment of the cast-coated layer, by varnishing for example, prior to metallization is avoided. Metal vapour deposition, with a very good metallic lustre, can be carried out immediately on the high-gloss surface layer of a cast-coated paper of this kind.

Typical of all cast-coated papers (metallized or non-metallized) is their low level of compaction in the production operation—in contrast to papers whose high-gloss surface layers are obtained by calendering methods, which are associated with a very high level of compaction, particularly of the fibre structure. The low level of compaction of cast-coated papers goes hand in hand with a high level of intactness of the paper fibre structure, with high volume (thickness) and substantial (inherent) rigidity of the label, properties which in general have the effect of additionally impairing the labelling properties and/or of making them incalculable and unmanageable.

Arising out of the prior art, therefore, the technical problem addressed by the present invention is that of providing a paper which has improved labelling properties, particularly in the context of the wet labelling of bottles. The intention, then, in particular is that the reliability of the labelling operation should be increased through the provision of an improved paper. A further intention is that the label provided on its reverse face with adhesive, following application to the bottle that is to be labelled, should adhere better to the bottle, so that in subsequent press-on steps and drying steps it no longer slips or falls from the bottle. Corners and edges of the labels ought not to stick out, but instead ought to bond fully to the bottle. Another objective of the present invention is the provision of a process for producing a cast-coated paper having improved labelling properties.

The technical problem is solved by a process for producing a coated paper, comprising the steps of:

a) providing a base paper, the fraction of long-fibre chemical pulp in the base paper being at least 25% by weight, the base paper having a water absorbency to ISO 535 for a test time of 10 s ($Cobb_{10}$) of 5 to 20 g/m$^2$, and
   the base paper having a (Fenchel) wet elongation, measured parallel to the machine direction, of not greater than 0% and, measured transverse to the machine direction, of not greater than 3%,
b) applying 10 to 40 g/m$^2$ (ovendry) of an aqueous coating composition to at least one face of the base paper, to give a coated base paper, and
c) conditioning the coated paper obtained in step b).

The coated paper of the present invention is preferably a cast-coated paper.

The term "long-fibre chemical pulp" refers in the context of the present invention to a chemical pulp which has a longer fibre length than, say, short-fibre chemical pulp. An example of a long-fibre chemical pulp is a softwood sulphate or softwood sulphite pulp. The base paper contains preferably at least 30 percent by weight, more preferably at least 35 percent by weight and most preferably at least 40 percent by weight of long-fibre chemical pulp.

The water absorbency is determined in agreement with ISO 535. ISO 535 defines the method known as the "Cobb method". This involves determining the water absorption of a paper after it has been exposed to water. In the present case the testing time is 10 seconds. The paper under test is exposed to water in excess for 8 seconds and after a total of 10 seconds the excess water is removed by means of a blotting sheet.

The base paper of the present invention has a $Cobb_{10}$ value of preferably 5 to 15 g/m$^2$, more preferably 5 to 13 g/m$^2$ and most preferably 6 to 10 g/m$^2$.

The Fenchel wet elongation was determined using an apparatus as described by Siebel in "Handbuch der Werkstoffprüfung", 2nd Edition, 4th Volume (1953, Springer-Verlag), page 241 ff. The elongation or contraction behaviour of papers or cards with water is tested by cutting a test strip 15 mm wide from the paper or card under test. Prior to the measurement of the wet elongation, the test strip is conditioned in a climate of 23° C. and 50% relative humidity. The strip is fastened in the testing apparatus, an additional weight being mounted as a function of the basis weight of the sample. The additional weights to be used can be found in Table 1. When the test strip has been clamped in, the water container, which is filled with water at 23° C. (±2° C.), is raised and screwed in, so that the strip is fully immersed in water. After a minute the water container is removed, downwardly, and after a further 3 minutes (a total of 4 minutes after wetting of the test strip with water) the elongation is read off in millimeters. The elongation is then given by the measured elongation (in millimeters) divided by the clamped-in length of the test strip (e.g. 200 mm), multiplied by 100.

TABLE 1

| Basis weight [g/m$^2$] | Additional weight [g] |
|---|---|
| up to 125 | 25 |
| 126-150 | 30 |
| 151-175 | 35 |
| 176-200 | 40 |
| 201-225 | 45 |
| 226-250 | 50 |

The wet elongation parallel to the machine direction is determined with the long face of the test sample pointing in the machine direction. Correspondingly, the wet elongation transverse to the machine direction is measured with the long face of the sample for measurement pointing transverse to the machine direction. At sampling it is important to ensure that the long face of the sample for measurement is pointing exactly in the machine direction or exactly transverse to the machine direction, respectively, since otherwise the corresponding wet elongations in transverse direction or longitudinal direction are averaged in accordance with the angular deviation of the sampling. It must therefore be ensured that sampling does not take place at a diagonal to the machine direction. A negative wet elongation means that the test strip has undergone contraction in the measurement direction during the measurement.

In a further-preferred embodiment the base paper shortens when the wet elongation is measured, so giving a negative wet elongation. This negative wet elongation parallel to the machine direction is situated preferably in the range from 0% to −1.0%, more preferably from −0.1% to −1.0% and most preferably in the range from −0.25% to −1.0%. In particular the wet elongation is situated preferably in the range from −0.5% to −1.0%.

The wet elongation of the base paper as measured transverse to the machine direction is preferably not greater than 2.5%, more preferably not greater than 2.0%, in a further-preferred embodiment not greater than 1.5% and most preferably not greater than 1%. In a further-preferred embodiment the wet elongation measured transverse to the machine direction is not greater than 0.8%, more preferably not greater than 0.3% and in one preferred embodiment not greater than 0%.

The coating applied in step b) has no substantial effect on the wet elongation of the base paper. Hence, preferably, the coated paper after step c) has substantially the same wet elongation as the base paper used to produce it. In this preferred embodiment, in particular, the wet elongations reported for the base paper can be transposed to the coated paper after step c).

In one preferred embodiment the wet elongation of the coated paper after step c), measured parallel to the machine direction, is 0%. In a further-preferred embodiment the coated paper shortens when the wet elongation is measured, so giving a negative wet elongation. This negative wet elongation parallel to the machine direction is situated preferably in the range from 0% to −1.0%, more preferably from −0.1% to −1.0% and most preferably in the range from −0.25% to −1.0%. In particular the wet elongation is situated preferably in the range from −0.5% to −1.0%.

The wet elongation of the coated base paper after step c), measured transverse to the machine direction, is preferably not greater than 2.5%, more preferably not greater than 2.0%, in a further-preferred embodiment not greater than 1.5% and most preferably not greater than 1%. In a further-preferred embodiment the wet elongation measured transverse to the machine direction is not greater than 0.8%, more preferably not greater than 0.3% and in one preferred embodiment not greater than 0%.

In one preferred embodiment the base paper as per ISO 287 has an absolute moisture content of not less than 2.5%. With further preference the base paper in step a) has an absolute moisture content of not less than 3.0%, in particular of not less than 3.5% and most preferably of less than 4.0%.

The basis weight of the base paper in step a), measured in accordance with EN ISO 536, can be between 20 and 150 g/m$^2$. The basis weight is preferably between 20 and 100 g/m$^2$, more preferably between 30 and 90 g/m$^2$ and most preferably between 40 and 80 g/m$^2$.

In step b), following application of the coating composition, the coated base paper is preferably treated with a glazing press to give a cast-coated paper, the ISO 287 absolute moisture content of the coated base paper prior to entry into the glazing press being greater than 1.5%.

In step b) of the process preferably 18 to 30 g/m$^2$ (ovendry) of the aqueous coating composition are applied to the base paper. With further preference between 20 and 25 g/m$^2$ (ovendry) of the aqueous coating composition are applied in step b).

The coating preferably comprises one or more pigments. Examples of suitable pigments are kaolin, clay, aluminium hydroxide, satin white, barium sulphate, calcium carbonate, talc, calcined kaolin and titanium dioxide, and the pigments can be used individually or in mixtures. An organic pigment, such as a plastic pigment, for example, may also be present in the coating. At least 50% by weight of the pigments employed preferably have a particle size of less than 2 μm.

The coating preferably comprises a binder which is typical within the field of the present invention. The binder may be a synthetic or a natural binder. Examples of suitable binders include a styrene-butadiene latex, methyl methacrylate-butadiene latex, styrene-vinyl acetate latex, vinyl acetate-acrylate latex, styrene-acrylate-acrylonitrile latex. Alternatively casein, soya bean protein and/or polyvinyl alcohol may be used as binders.

Customary additives may be present in the coating, such as thickeners, surface-active substances, optical brighteners and dyes, for example.

The solids content of the aqueous coating composition prior to application to the paper web in step b) is preferably 5% to 68% by weight, more preferably 10% to 65% by weight and most preferably 15% to 65% by weight.

The glazing press in step b) of the process may preferably have a reverse-face moistening assembly. With this reverse-face moistening assembly it is then possible to treat the reverse face of the coated base paper with a preparation comprising water. The construction of this reverse-face moistening assembly may be in accordance with that which is familiar to a skilled person. In particular the reverse-face moistening assembly may be a water press in which the water-containing preparation is applied via 2 rolls to the reverse face of the coated base paper. Within the glazing press, the reverse-face moistening assembly is arranged upstream of the cylinder having the mirror-gloss surface. The coated base paper is therefore moistened on the reverse face before being contacted with the mirror-gloss surface of the cast coating cylinder. The reverse-face moistening assembly resolves stresses in the base paper, thereby further improving the labelling characteristics of the complete cast-coated paper. In particular, with this preferred embodiment, the conformance of the label on wet labelling, around the bottles that are to be labelled, is even better.

The preferred cast-coating process is not limited per se. The cast-coating process used may in particular be the direct process, the rewet process or the gel process. Preference is given to the rewet process, in which the coating composition is first applied to the base paper and then dried. Subsequently, on entry into the glazing cylinder, the coating is moistened again, so that the mirror-smooth surface of the cast coating cylinder has been transferred to the paper when it has left the glazing press.

In one preferred embodiment in step b) the absolute moisture content of the coated base paper prior to entry into the glazing press is 2% to 7%. If, in one preferred embodiment, the rewet process is used, entry into the glazing press is understood to mean the point in time before the paper that has already been coated and dried is rewetted. If the glazing press has a reverse-face moistening assembly, the absolute moisture content of the coated base paper prior to entry into the reverse-face coating assembly is within the stated range.

In one preferred embodiment the absolute moisture content of the coated base paper prior to entry into the glazing press is 2% to 6%, more preferably 2.5% to 4% and most preferably 2.5% to 3.5%.

In step c) of the process described here, the coated paper is conditioned. Conditioning here means the establishment of a predefined equilibrium moisture content in the coated paper. The predefined equilibrium moisture content of the coated paper amounts preferably to 50% relative humidity. Conditioning can be carried out using any assembly known to the skilled person, in particular with a chamber having a preselected relative atmospheric humidity. The paper web is then passed through such a chamber until the paper web has the desired equilibrium moisture content. In this case the conditions preselected in the chamber are adapted to the desired equilibrium moisture content of the paper. In one preferred embodiment the cast-coated paper is conditioned in an atmosphere which has a relative humidity of at least 90%.

The conditioning is preferably carried out such that the coated paper, after conditioning to an equilibrium moisture content of 50% relative humidity (standard conditions), has a deviation from flatness, as measured parallel to the machine direction, of less than 10 mm in the direction of the coated face (stretching elongation) and, measured transverse to the machine direction, of less than 10 mm in the direction of the coated face (swelling elongation).

The flatness is preferably determined using the cross cut method. In this method a square piece measuring approximately 20×20 cm is cut from the paper web. It is important that the machine direction be indicated on the test paper and that the edges of the test piece be arranged parallel or transverse to the machine direction. A cross-shaped cut approximately 18 cm in length is then made within the square diagonally to the corners of the square. The flatness is then checked at the triangular ends of the incisions that have been made. It is determined from the distance of the ends from the support of the test paper, so that the stretching elongation in millimeters is the distance of the top or bottom end, respectively, from the support surface of the paper. The swelling elongation, correspondingly, is the distance of the ends of the left-hand or right-hand triangular cutout from the support point of the paper.

In this context, in respect of the swelling elongation, the term "moisture flatness" is also used, since the swelling elongation that occurs can be adjusted within certain limits by moistening the paper. Correspondingly, the stretching elongation is referred to as mechanical flatness, since it can be influenced by, for example, a breaker blade. In this case the paper web is deformed under tension in such a way that the desired stretching elongation comes about.

The stretching elongation is preferably less than 8 mm in the direction of the coated face, more preferably less than 5 mm in the direction of the coated face and most preferably less than 3 mm in the direction of the coated face. In a further preferred embodiment the stretching elongation is 0 mm, which means that the paper exhibits no stretching elongation.

In a further preferred embodiment the swelling elongation is less than 8 mm on the coated face, more preferably less than 5 mm in the direction of the coated face and most preferably less than 3 mm in the direction of the coated face. In one particularly preferred embodiment the swelling elongation is 0 mm, which means that the paper exhibits no swelling elongation and lies flat on a substrate.

After conditioning in step c) the coated paper preferably has an absolute moisture content to ISO 287 of 2% to 10%, more preferably of 2% to 8% and most preferably of 2% to 7%.

In one preferred embodiment it is possible after step b) and before step c) to apply a metal layer to the coated face of the coated paper. This metal layer may be applied preferably by vacuum vapour deposition. The metal layer preferably comprises aluminium. With further preference the metal layer is an aluminium layer.

In one preferred embodiment, before the application of the metal layer to the coated face of the coated paper, the coated face is varnished. In this context it is possible to use all of the varnish coatings that are familiar to the skilled person in order to make the surface of the cast-coated paper more smooth. This varnish coating can be applied with any application assembly known to the skilled person. The varnish coating is applied preferably by means of a flexographic printing process, in which the printing ink may be solvent-borne or water-based.

In a further-preferred embodiment a varnish coating is applied to the metal layer after the metal layer has been applied. As the varnish coating it is possible to use any varnish coating which is familiar to the skilled person. In particular the varnish coating can be applied using any application assembly known to the skilled person, the varnish coating being applied preferably by means of a flexographic printing process. The printing ink used may include not only solvent-borne printing inks but also water-based printing inks.

In one preferred embodiment the coated paper, prior to application of the metal layer, has an absolute moisture content to ISO 287 of 0.5% to 10%. In a further preferred embodiment the coated paper, prior to application of the metal layer, has an absolute moisture content of 0.5% to 8%, more preferably of 1% to 7%, more preferably still of 1.5% to 6% and most preferably of 2% to 5%.

The present invention further provides a coated paper comprising a base paper and a coating applied to the base paper, the fraction of long-fibre chemical pulp in the base paper being at least 25% by weight, the base paper having a water absorbency to ISO 535 for a test time of 10 s ($Cobb_{10}$) of 5 to 20 g/m$^2$, and the base paper having a (Fenchel) wet elongation, measured parallel to the machine direction, of not greater than 0% and, measured transverse to the machine direction, of not greater than 3%, and the coating having a coat weight of 10 g/m$^2$ to 40 g/m$^2$ (ovendry).

The coated paper is preferably a cast-coated paper.

The coated paper has a flatness parallel to the machine direction of less than 10 mm in the direction of the coated face (stretching elongation) and transverse to the machine direction of less than 10 mm in the direction of the coated face (swelling elongation), as measured using the cross cut method (as described above).

In one preferred embodiment the coated paper is characterized by a flatness behaviour in a cycle of conditioning at different relative humidities. For this purpose the paper, which preferably has a size of 10×7 cm (rectangular), is conditioned at different relative humidities. In the course of the production of a test paper of this kind it is important that the edges of the rectangle are aligned precisely parallel to the machine direction or cross direction of the paper web. The longer face of the rectangular cutout is preferably oriented parallel to the machine direction, so that the machine direction (longer face of the rectangle) is not confused with the cross direction. The swelling elongation is the distance of the edges from a planar support of the rectangular test paper, and is measured at the edges oriented parallel to the machine direction. Correspondingly, a stretching elongation is the distance of the edges aligned transverse to the machine direction from a planar substrate. Since the present invention preferably concerns a one-face coated paper, the swelling elongation and the stretching elongation may each point either to the coated or uncoated face of the paper.

When carrying out the cycle it is important that, at the humidities stated respectively, the paper is conditioned preferably until the equilibrium moisture content is obtained.

The paper of the invention here shows a flatness behaviour wherein a) at a relative moisture content of 50% the paper has a swelling elongation of between 5 mm to the uncoated face of the paper and mm to the coated face, b) after subsequent conditioning to a relative moisture content of 80%, the paper has a swelling elongation to the coated face of the paper of 0 to 30 mm, c) after subsequent conditioning to a relative moisture content of 45%, the paper has a swelling elongation to the uncoated face of the paper of 0 to 10 mm, d) after subsequent conditioning to a relative moisture content of 80%, the paper has a swelling elongation to the coated face of the paper of 0 to 30 mm, and e) after subsequent conditioning to a relative moisture content of 45%, the paper has a swelling elongation to the uncoated face of the paper of 0 to 10 mm.

The coated paper, moreover, preferably has what is called a "work capacity". The work capacity in the sense of this invention is the mean of the difference in the swelling elongations of step b) and c) and the difference in the swelling elongations of step d) and e), the mean being preferably 2 mm to 40 mm.

If, then, as an example, in step b) a swelling elongation to the coated face of the paper of 28 mm is measured, in step c) a swelling elongation of 8 mm to the uncoated face, in step d) again a swelling elongation to the coated face of the paper of 27 mm, and in step e) a swelling elongation of 9 mm to the uncoated face of the paper is measured, then the work capacity in mm is (((28 mm−(−8 mm))+(27 mm−(−9 mm)))/2. In this example, therefore, the cast-coated paper would have a work capacity of 36 mm.

With preference the coated paper of the present invention exhibits no stretching elongation as it traverses the flatness cycle described above. Instead, preferably, with different forms of conditioning, the paper will always continue to exhibit a swelling elongation to the coated or uncoated face of the paper.

Surprisingly it is the case that the cast-coated paper of the present invention has improved labelling characteristics as compared with the papers of the prior art. In particular, in wet labelling, the paper of the present invention conforms to the bottle that is to be labelled when applied to the bottle, so that there is a kind of looping of the bottle by the label. This ensures that the label does not slip as a result of the subsequent brushing down. Moreover, as a result of this looping behaviour, the labels adhere more firmly to the bottles, thereby preventing the labels falling off in the automatic labelling unit. For this reason the paper of the present invention results in an increase in the reliability of the labelling operation. The labelling plant downtime is reduced, since the number of cleaning cycles which would otherwise be necessary in order to clean the labelling unit of fallen labels is reduced.

Furthermore, with the label of the present invention, following application to, say, bottles, the corners and edges do not stick out. As already described, the coated paper of the present invention conforms to the bottle that is to be labelled. This also prevents the formation of creases on the label. Even where creases do form when the label is applied to the bottle, these creases are pulled smooth again as a result of the looping of the label. The label therefore has a flat lie on, for example, a bottle.

A further advantage exists in the case of what are called neck labels. Neck labels are labels which are applied to the neck of a bottle. Since the bottle neck generally differs quite significantly from the cylindrical outline of the bottle, it is particularly complicated at this point to attach a label whose seating is exact. Surprisingly, even at this very geometrically demanding location on a bottle, the coated paper of the present invention exhibits improved labelling characteristics. The coated paper of the present invention conforms exactly to the shape, for example, of a bottle neck. Consequently there is improved machine running during labelling, and the applied label does not exhibit any creasing.

A further advantage of the present invention that occurs in the context of wet labelling using the coated paper of the present invention is that, when the glued label is applied to a bottle, there is, preferably, a jumping of the label into a stretching elongation to the uncoated, i.e. glued, face of the label. This promotes the looping of the bottle, for example, by the label. Without wishing to be attached to any one theory it is assumed that this effect can also be attributed to the (Fenchel) wet elongation of the coated paper of the present invention.

It is also possible in addition to apply a metal layer to the coated paper of the present invention, specifically to the coating of the coated paper. As already described, it is possible for there to be further layers present beneath the metal layer and/or above the metal layer, these further layers preferably being varnish coatings. The metal layer preferably comprises aluminium, which with further preference is applied by vapour deposition.

EXAMPLES

Inventive Example 1

One-face coated paper is produced as follows:

A fibre mixture having the following composition is processed in the paper machine (Table 2):

TABLE 2

| Fibre composition | % by weight |
|---|---|
| Long fibre | 50 |
| Short fibre | 50 |
| Filler | 12 |
| Assistants | 1.5 |

The coating base paper produced in this way has a basis weight of 50 g/m$^2$ (bone-dry) and an absolute moisture content of 3%.

The Fenchel wet elongation is −0.1% parallel to the machine direction and 2.4% transverse to the machine direction.

The coating base paper is coated on one face with a pigmented coating slip composition and subsequently conditioned in a conditioner.

TABLE 3

| | |
|---|---|
| Coating mass after application | 23 g/m$^2$ (ovendry) |
| Reverse-face moistening | with water |
| Moisture content on entry to glazing press | 8% |
| Relative humidity in conditioner | 90% |
| Temperature in conditioner | 45° C. |

The coated paper (completed paper) produced in this way has an absolute moisture content of 6%.

The completed paper has a water absorbency on the uncoated face to ISO 535 for a test time of 10 s (Cobb$_{10}$) of 12 g/m$^2$.

The completed paper has a flatness, measured parallel and transverse to the machine direction, of 0 mm to the coated face, and the Fenchel wet elongation is −0.1% measured parallel to the machine direction and 2.4% transverse to the machine direction.

When the flatness behaviour of this completed paper is determined at different relative humidities, the behaviour apparent is as follows (Table 4).

TABLE 4

| Flatness cycle | |
|---|---|
| 50% rel. humidity Initial flatness | 0 mm |
| 80% rel. humidity Step 1 | 25 mm to the coated face |
| 45% rel. humidity Step 2 | 0 mm |
| 80% rel. humidity Step 3 | 27 mm to the coated face |
| 45% rel. humidity Step 4 | 0 mm |
| Work capacity (calculated) | 26 mm |

This coated paper exhibits very good characteristics during the labelling operation (gluing of the label, removal from glue pallet). Only at the point of transfer from the gripper fingers of the labelling unit to the container does the label "jump" from a swelling elongation into a stretching elongation to the reverse face and, in so doing, "embrace" the container. Labels which exhibit the characteristics described above can be applied without problems to different containers without accompanying creasing, sticking-out corners or similar defects. In addition, favoured by the above characteristics, it is possible to save up to 10% of the typical glue quantity.

Inventive Example 2

An aluminium-coated completed paper is produced as follows:

A fibre mixture having the following composition is processed in the paper machine (Table 5):

TABLE 5

| Fibre composition | % by weight |
|---|---|
| Long fibre | 50 |
| Short fibre | 50 |
| Filler | 12 |
| Assistants | 1.5 |

The coating base paper produced has a basis weight of 51 g/m$^2$ (bone-dry) and an absolute moisture content of 3%.

The Fenchel wet elongation is −0.12% parallel to the machine direction and 2.4% transverse to the machine direction.

The coating base paper is coated on one face under the following conditions with a pigmented coating composition (Table 6).

TABLE 6

| | |
|---|---|
| Coating mass | 26 g/m$^2$ (ovendry) |
| Reverse-face moistening | with water |
| Moisture content on entry to glazing press | 4% |
| Conditioning | off |
| Temperature | off |

The coated paper produced in this way has an absolute moisture content of 2%.

In an aluminium vapour deposition unit a thin layer of aluminium is applied under a high vacuum to the coated face of the aforementioned coated paper.

The aluminium-coated paper is then conditioned using a separate conditioner.

The coated and vapour-coated paper (completed paper) produced in this way has an absolute moisture content of 6%.

The water absorbency of the uncoated face to ISO 535 for a test time of 10 s ($Cobb_{10}$) is 11 g/m$^2$.

Furthermore, the completed paper produced has a flatness, measured parallel and transverse to the machine direction, of 0 mm.

The completed paper produced in this way has a Fenchel wet elongation of −0.12 as measured parallel to the machine direction and 2.4% transverse to the machine direction.

When the flatness behaviour of this completed paper is determined at different relative humidities, the following characteristics are found (Table 7):

TABLE 7

| Flatness cycle | |
|---|---|
| 50% rel. humidity Initial flatness | 0 mm |
| 80% rel. humidity Step 1 | 23 mm to the coated face |
| 45% rel. humidity Step 2 | 0 mm |
| 80% rel. humidity Step 3 | 25 mm to the coated face |
| 45% rel. humidity Step 4 | 0 mm |
| Work capacity (calculated) | 24 mm |

This completed paper exhibits very good characteristics during the labelling operation (gluing of the label, removal from glue pallet). Only at the point of transfer from the gripper fingers of the labelling unit to the container does the label "jump" from a swelling elongation into a stretching elongation to the reverse face and, in so doing, "embrace" the container. Labels which exhibit the characteristics described above can be applied without problems to different containers without accompanying creasing, sticking-out corners or similar defects. In addition, by virtue of the above characteristics, it is possible to save up to 10% of the typical glue quantity.

Comparative Example 3

This example concerns a one-face coated, aluminium-coated label paper having a basis weight of 80 g/m$^2$.

The competition material has an absolute moisture content of 5.5% and a water absorbency to ISO 535 for a test time of 10 s ($Cobb_{10}$) of 8 g/m$^2$.

The flatness, measured parallel and transverse to the machine direction, is in each case 0 mm to the coated face.

The Fenchel wet elongation is 0.25% measured parallel to the machine direction and 2.5% transverse to the machine direction.

The flatness behaviour of this material was analysed in accordance with the procedure described in the specification (Table 8).

TABLE 8

| Flatness cycle | |
|---|---|
| 50% rel. humidity Initial flatness | 0 mm |
| 80% rel. humidity Step 1 | 20 mm to the coated face |
| 45% rel. humidity Step 2 | 0 mm |
| 80% rel. humidity Step 3 | 24 mm to the coated face |
| 45% rel. humidity Step 4 | 4 mm to the coated face |
| Work capacity (calculated) | 20 mm |

This completed paper (competition material) exhibits normal characteristics during the labelling operation (gluing of the label, removal from glue pallet). At the point of transfer from the gripper fingers to the container, however, the label does not "jump" from a swelling elongation into a stretching elongation to the reverse face. This label requires additional pressing to the container surface using the pressing rolls and/or brushes that are present in the labelling station. As a result of stresses in the label paper or errors in the positioning of the label, defects are frequent, such as sticking-out corners, creases, mispositioning or the like. In addition, as a result of the higher quantity of glue needed, there is fouling of the containers or of the labelling unit, which implies shorter cleaning cycles of the labelling unit.

What is claimed is:

1. Coated paper comprising a base paper and a coating applied to one face of the base paper, the fraction of long-fiber chemical pulp in the base paper being at least 25% by weight, the base paper having an absolute moisture content to ISO 287 of not less than 2.5%, the base paper having a water absorbency to ISO 535 for a test time of 10 s ($Cobb_{10}$) of 5 to 20 g/m$^2$, and the base paper having a (Fenchel) wet elongation, measured parallel to the machine direction, of not greater than 0% and, measured transverse to a machine direction, of not greater than 3%, and the coating having a coat weight of 10 g/m$^2$ to 40 g/m$^2$ (ovendry) and comprises at least a pigment and a binder.

2. Process for producing a coated paper according to claim 1, comprising the steps of:

a) providing said base paper, b) applying the 10 to 40 g/m$^2$ (ovendry) of the aqueous coating composition to at least one face of the base paper, to give a coated base paper, and c) establishing a predefined equilibrium moisture content in the coated paper obtained in step b).

3. Process according to claim 2, the coated paper being a cast-coated paper.

4. Process according to claim 2, the base paper in step a) having an absolute moisture content to ISO 287 of not less than 4%.

5. Process according to claim 2, wherein the base paper in step a) has a basis weight, measured to EN ISO 536, of 20 to 150 g/m$^2$.

6. Process according to claim 2, wherein the base paper in step a) has a (Fenchel) wet elongation parallel to the machine direction of 0% to −1.0% and transverse to the machine direction of less than 2.5%.

7. Process according to claim 2, wherein in step b), following application of the coating composition, the coated base paper is treated with a glazing press to give a cast-coated paper, the coated base paper having an absolute moisture content to ISO 287 of greater than 1.5% prior to entering the glazing press.

8. Process according to claim 2, wherein in step b) 18 to 30 g/m$^2$ (ovendry) of the aqueous coating composition are applied to the base paper.

9. Process according to claim 2, wherein the glazing press in step b) has a reverse-face moistening assembly and the reverse face of the coated base paper is treated, using the reverse-face moistening assembly, with a preparation comprising water.

10. Process according to claim 2, wherein in step b) the absolute moisture content of the coated base paper prior to entering a the glazing press is 2% to 7%.

11. Process according to claim 2, wherein in step c) the cast-coated paper is conditioned in an atmosphere which has a relative humidity of at least 90%.

12. Process according to claim 2, wherein in step c) the coated paper after conditioning has a flatness, measured parallel to the machine direction, of less than 10 mm in a direction of the coated face (stretching elongation) and, measured transverse to the machine direction, of less than 10 mm in the direction of the coated face (swelling elongation).

13. Process according to claim 2, wherein in step c) the coated paper after conditioning has an absolute moisture content to ISO 287 of 2% to 10%.

14. Process according to claim 2, wherein after step b) and before step c) a metal layer is applied to the coated face of the cast-coated paper.

15. Process according to claim 14, wherein the metal layer is applied by vacuum vapour deposition.

16. Process according to claim 14, wherein the metal layer comprises aluminium.

17. Process according to claim 14, wherein the coated paper, prior to application of the metal layer, has an absolute moisture content to ISO 287 of 0.5% to 10%.

18. Coated paper according to claim 1, the coated paper being a cast-coated paper.

19. Coated paper according to claim 1, the coated paper having a deviation from flatness parallel to the machine direction of less than 10 mm in a direction of the coated face (stretching elongation) and transverse to the machine direction of less than 10 mm in the direction of the coated face (swelling elongation).

20. Coated paper according to claim 1, wherein:

a) at a relative moisture content of 50% the paper has a swelling elongation of between 5 mm to the uncoated face of the paper and 5 mm to the coated face, b) after subsequent conditioning to a relative moisture content of 80%, the paper has a swelling elongation to the coated face of the paper of 0 to 30 mm, c) after subsequent conditioning to a relative moisture content of 45%, the paper has a swelling elongation to the uncoated face of the paper of 0 to 10 mm, d) after subsequent conditioning to a relative moisture content of 80%, the paper has a swelling elongation to the coated face of the paper of 0 to 30 mm, and e) after subsequent conditioning to a relative moisture content of 45%, the paper has a swelling elongation to the uncoated face of the paper of 0 to 10 mm.

21. Coated paper according to claim 20, wherein the mean of the difference in the swelling elongations of step b) and c) and of the difference in the swelling elongations of step d) and e) is 2 mm to 40 mm.

22. Coated paper according to claim 20, wherein in steps b) to e) the paper has no stretching elongation to the coated or uncoated face.

23. Coated paper according to claim 20, wherein a metal layer has been applied to the coating of the coated paper.

24. Coated paper according to claim 23, wherein the metal layer comprises aluminium.

25. Coated paper obtainable according to a method comprising providing a base paper, applying 10 to 40 g/m$^2$ (oven-dry) of an aqueous coating composition to one face of the base paper to give a coated base paper and establishing a predefined equilibrium moisture content, the fraction of long-fiber chemical pulp in the base paper being at least 25% by weight, the base paper having an absolute moisture content to ISO 287 of not less than 2.5%, the base paper having a water absorbency to ISO 535 for a test time of 10 s ($Cobb_{10}$) of 5 to 20 g/m$^2$, the base paper having a (Fenchel) wet elongation, measured parallel to the machine direction, of not greater than 0% and, measured transverse to the machine direction, of not greater than 3%, and the coating comprising at least a pigment and a binder.

26. A method of labeling a product comprising applying the coated paper of claim 1 to said product.

27. A method of labeling a product comprising the step of applying the coated paper of claim 25 to said product.

* * * * *

UNITED STATES PATENT AND TRADEMARK OFFICE

CERTIFICATE OF CORRECTION

PATENT NO. : 8,202,624 B2
APPLICATION NO. : 12/302266
DATED : June 19, 2012
INVENTOR(S) : Becher et al.

It is certified that error appears in the above-identified patent and that said Letters Patent is hereby corrected as shown below:

At column 7, line 64, before "mm" please insert --5--.

At column 13, line 6, in Claim 9, after "entering a" please delete "the".

At column 14, line 39, in Claim 26, after "comprising" please delete "the step of".

Signed and Sealed this
Nineteenth Day of February, 2013

Teresa Stanek Rea

Teresa Stanek Rea
*Acting Director of the United States Patent and Trademark Office*